US009872520B1

(12) United States Patent
Elson

(10) Patent No.: US 9,872,520 B1
(45) Date of Patent: Jan. 23, 2018

(54) VAPORIZER WITH MEANS TO POWER AND RECHARGE ELECTRICAL DEVICES

(71) Applicant: Jeffrey Alan Elson, Westhampton, NY (US)

(72) Inventor: Jeffrey Alan Elson, Westhampton, NY (US)

( * ) Notice: Subject to any disclaimer, the term of this patent is extended or adjusted under 35 U.S.C. 154(b) by 668 days.

(21) Appl. No.: 14/316,405

(22) Filed: Jun. 26, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 6,715,494 | B1 | 4/2004 | McCoy | |
| 7,293,565 | B2 | 11/2007 | Griffin et al. | |
| 7,434,584 | B2 | 10/2008 | Steinberg | |
| 8,256,642 | B2 | 9/2012 | McNamara et al. | |
| 2009/0032034 | A1 | 2/2009 | Steinberg | |
| 2009/0260642 | A1* | 10/2009 | Monsees | A24F 47/006 131/194 |
| 2012/0168440 | A1 | 7/2012 | Nerswick et al. | |
| 2013/0032159 | A1 | 2/2013 | Capuano | |
| 2013/0042865 | A1* | 2/2013 | Monsees | A61M 15/06 128/203.27 |
| 2013/0298905 | A1* | 11/2013 | Levin | A24F 47/008 128/202.21 |
| 2014/0041655 | A1* | 2/2014 | Barron | A61M 11/042 128/202.21 |
| 2014/0096781 | A1* | 4/2014 | Sears | A24F 47/008 131/328 |
| 2014/0261490 | A1* | 9/2014 | Kane | A24F 47/008 131/328 |

* cited by examiner

*Primary Examiner* — Eric Yaary
(74) *Attorney, Agent, or Firm* — Robert J Hess; Hess Patent Law Firm

(57) ABSTRACT

Vaporizer includes a housing defining a substance retaining compartment, a heating element, a mouthpiece communicating with the compartment through which vaporized substance is discharged from the housing, and a rechargeable power storage unit that provides power to the heating element to enable the heating element to heat the compartment when activated. The housing includes a first port that mates with a first cable connectable to an electricity supply, and a charging unit interposed between and electrically coupled to the first port and the power storage unit. The power storage unit is charged when the first port is mated with the first cable connected to the electricity supply. A second port is electrically coupled to the power storage unit and mates with a second cable connectable to a power using device. Electricity from the power storage unit powers the device via the second port and the second cable.

18 Claims, 5 Drawing Sheets

VAPORIZER WITH MEANS TO POWER AND RECHARGE ELECTRICAL DEVICES

FIELD OF THE INVENTION

The present invention relates generally to a vaporizer for inhaling vaporized substances, and more particularly to a vaporizer that can be used to power and/or recharge electronic devices.

BACKGROUND OF THE INVENTION

Tobacco and flavor compounds are typically smoked by burning and inhaling combustion fumes and smoke. Alternatively, the technique of vaporization is used, wherein the substance(s) is vaporized by heating so that desired flavor and psychoactive components are liberated, and combustion is minimized.

Vaporization is generally considered a smoother and more flavorful process, and more efficient use of smoking materials, as compared to burning, because desired flavor and psychoactive compounds are not destroyed by combustion.

Vaporizers in use today are often electrically powered. For example, U.S. Pat. No. 7,434,584 (Steinberg) and 20090032034 (Steinberg) describe vaporizer devices that use a flame and psychoactive compounds from smoking materials, such as tobacco, as the source of vaporizing flavor. The device includes a filter unit with a porous flame filter that is made of open-cell ceramic or metal foam, sintered ceramic or metal granules or other porous, heat resistant materials. In use, a flame is supplied to the flame filter, and inhalation causes ambient air to enter the flame filter. The flame exhaust and ambient air are mixed within the flame filter and produce an air stream of intermediate temperature. The intermediate temperature air stream is sufficiently hot to vaporize desirable components from the smoking material(s).

An earlier vaporizer is described in U.S. Pat. No. 6,715,494 (McCoy) and includes a lower chamber member having a bowl portion that holds materials from which vapor is to be extracted. The bowl portion communicates with a vapor intake conduit at a vapor intake orifice thereof arranged below the bowl portion. The vapor intake conduit mates with a smoking pipe conduit. A lower screen member is arranged in the bowl portion over the vapor intake orifice. An upper chamber member mates with the lower chamber portion in a substantially air-tight manner to form a vaporization chamber. The upper chamber member communicates with a conical-shaped heat intake conduit and has a heat intake orifice at a distal end that accepts output from a heat source. A heated intake air turbulence member includes an impeller arranged between the heat intake orifice and the vapor intake orifice.

SUMMARY OF THE INVENTION

An embodiment of the present invention provides a vaporizer for inhaling vaporized substances.

Another embodiment of the present invention is to provide a vaporizer that can power and/or recharge electronic devices.

Accordingly, a vaporizer in accordance with the invention includes a housing defining a substance retaining compartment, a heating element having an activated state and an unactivated state and heating the compartment when in the activated state in order to vaporize substance(s) in the compartment, a mouthpiece in communication with the compartment through which vaporized substance(s) is discharged from the housing, and a rechargeable power storage unit for storing electricity. The power storage unit provides power to the heating element to enable the heating element to heat the compartment, when the heating element is in the activated state.

To initially charge or recharge the power storage unit, a first port is arranged on the housing and engages or mates with a first cable connectable to an electricity supply, and a charging or recharging unit is interposed between and electrically coupled to the first port and the power storage unit. The power storage unit is thus charged when the first port is mated with the first cable connected to the electricity supply.

To power, initially charge or recharge another electrical device, a second port is electrically coupled to the power storage unit and engages or mates with a second cable connectable to a power using device. The first and second ports may be adjacent one another to provide a convenient form for use of the electrical functions of the housing. Electricity from the power storage unit powers the device via the second port and the second cable.

In a preferred embodiment, the housing includes a first substantially cylindrical part having an upper annular edge and a second lid part on which the mouthpiece and an opening leading to the compartment are formed. The second lid part rests on the upper annular edge of the cylindrical part.

An actuator controls activation of the heating element, and may have a first position in which the heating element is in the activated state and a second position in which the heating element is in its unactivated state. The actuator may be a button exposed on the housing. Inward, manual pressure on the button provides for activation of the heating element and absence of pressure on the button causes the heating element to be in its unactivated state.

A closure member selectively closes the compartment as closure of the compartment improves or is required for vaporization of the substance. Thus, the closure member has a first position in which the compartment is accessible to enable placement of the substance into the compartment and a second position in which the compartment is closed.

An indicator light on the housing is optionally configured to indicate the status of the charging of the power storage unit. In one embodiment, the indicator light is configured to blink or flash during charging of the power storage unit, maintain a solid lighted condition of a first color once the power storage unit is charged, and then again blink or flash when the power storage unit requires recharging.

A vaporizer assembly in accordance with the invention includes the vaporizer described above and two cables. For example, the assembly includes a first USB cable having a micro-USB connector at one end and a USB connector at the other end. This cable mates with a USB charger at one end and with the first port at the other end such that when mated with the USB charger (which is itself plugged into an electrical outlet) and the first port, the charging unit initially charges or recharges the power storage unit. Instead of using a USB charger, the first cable may be plugged directly into a USB port of, for example, a computer, laptop, etc. When the second port is configured with a micro-USB connector, the assembly further includes a second USB cable having a micro-USB connector at one end and a USB connector at the other end. This second cable mates with the second port at one end and with a power using device at the other end such that when mated with the second port and the power using device, the power storage unit provides power to the power using device.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
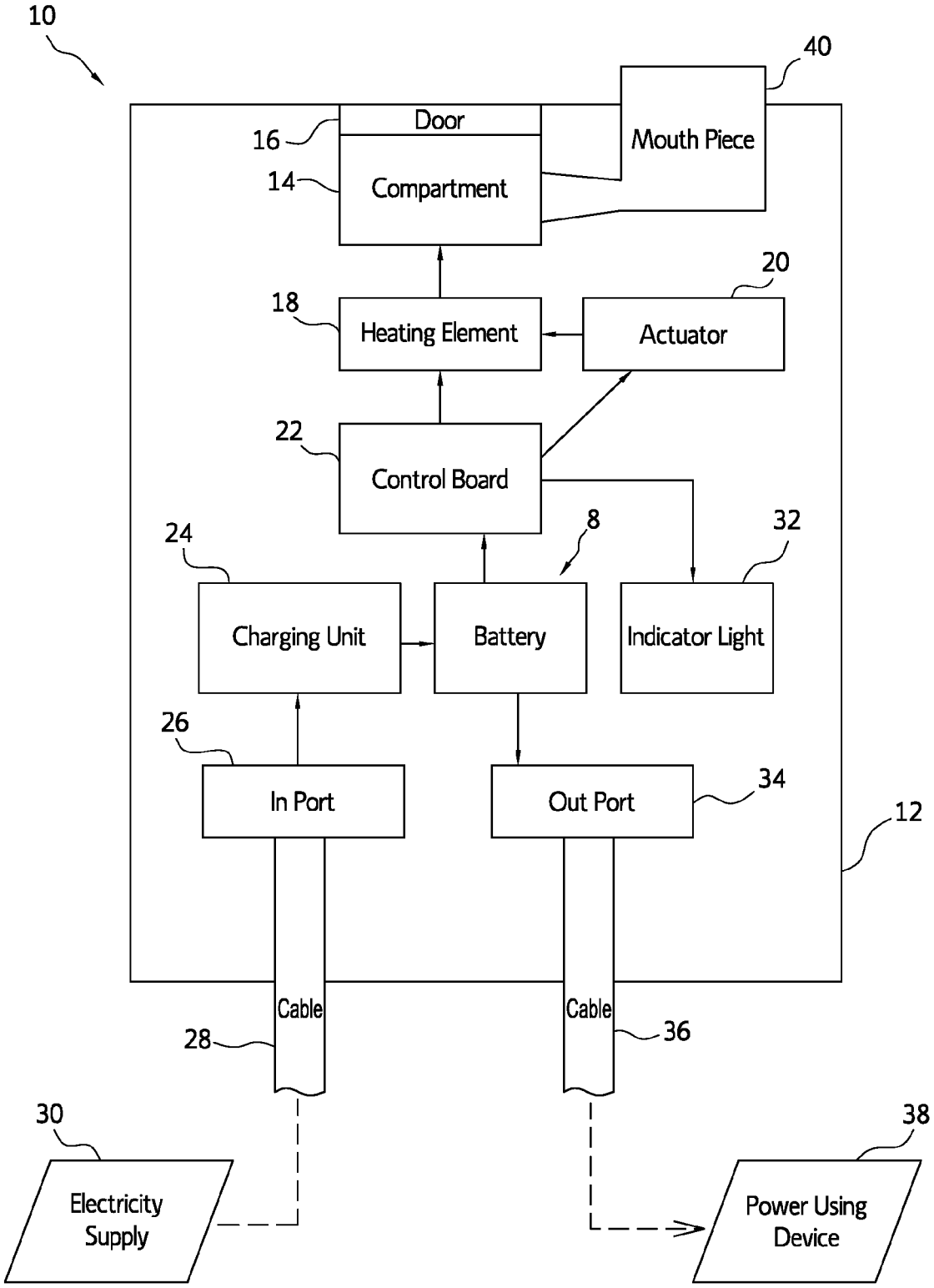
FIG. 1 is a schematic of a vaporizer assembly in accordance with the invention.

Referring to the accompanying drawings wherein the same reference numbers refer to the same or similar elements, FIG. 1 shows a schematic of a vaporizer assembly 10 in accordance with the invention. This schematic shows the primary components of the vaporizer assembly 10, as it should be understood that the particular components shown in FIGS. 2-6 do not limit the invention in any manner whatsoever. Additional details of the specific components are discussed below with reference to FIGS. 2-4.

Vaporizer assembly 10 includes a housing 12 including a compartment 14 selectively accessible via a door 16 or other closure member. Such a closure member may be considered closure means for selectively closing the compartment 14, such as by manual effort.

A herbal blend, tobacco, a flavor compound, a psychoactive compound or other related substance to be vaporized is inserted into the compartment 14 through the door 16 when open to be at least temporarily retained therein, and once a sufficient or a desired quantity of substance to be vaporized is present in the compartment 14, the door 16 is closed. Door 16 thus has a first position in which the compartment 14 is accessible to enable placement of the substance into the compartment 14 and a second position in which the compartment 14 is closed. The door 16 may be moved, e.g., slid, between the two positions.

Housing 12 also includes a heating element 18 that is associated with the compartment 14 to the extent it causes the substance in the compartment 14 to be heated when the heating element 18 is activated. Heating element 18 may be configured to be heated to a temperature of about 450-550° C., which is considered sufficient to vaporize typical substances that will be placed into the compartment 14. Other heating elements that heat to a different range of temperatures or different temperatures may also be used in the invention.

To activate the heating element 18, an actuator 20 is coupled to the heating element 18 and a control board 22, which in turn is coupled to a battery 8, that provides controlled electricity to power the heating element 18. Battery 8 represents a power storage unit and may comprise one or more batteries or other types of power storage units.

Actuator 20 may be constructed to have a first position in which the heating 18 element is activated and a second position in which the heating element 18 is in its unactivated state. For example, the actuator 20 may be a button exposed on the housing 12, whereby inward, manual pressure on the button provides for activation of the heating element 18 and absence of pressure on the button, i.e., manual release of the button, causes the heating element 18 to be in its unactivated state.

Battery 8 is rechargeable. To enable such recharging, a charging unit 24 is coupled to the battery 8 in any manner known to those skilled in the art, e.g., through one or more wires or other electrical componentry. Charging unit 24 is a component known to those skilled in the art. Charging unit 24 is powered by external power obtained via an in port 26 coupled to the charging unit 24. The coupling between the port 26 and the charging unit 24 may be any electrical coupling known to those skilled in the art to which this invention pertains, e.g., one or more wires.

Port 26 is adapted to receive one end of a cable 28, the opposite end of which is coupled directly or indirectly to a power source or electricity supply 30. Recharging of the battery 8 would preferably be automatic when the cable 28 is connected to the power source and port 26. Cable 28 may be a USB cable in which case, the port 26 is configured with a USB connector.

Monitoring of the recharging of the battery 8 by the charging unit 24 is provided by an indicator light 32 that is preferably configured to blink or flash during charging of the battery 8, i.e., during operation of the charging unit 24, maintain a solid lighted condition of a first color once the battery 8 is charged, i.e., when the charging unit 24 stops the recharging, and also blink or flash when the battery 8 requires recharging. Other lighting scenarios are also encompassed within the scope of the invention.

A discharge or out port 34 is also provided on or in the housing 12 and is coupled to the battery 8 in a manner known to those skilled in the art. Discharge port 34 is designed to mate with a second cable 36 connectable to a power using device 38 such that electricity from the battery 8 powers the device 38 via the port 34 and the cable 36. For example, the port 34 may be configured with a micro-USB connector so that a USB cable can be used as cable 36. The power using device may be a cell phone, smartphone, MP3 player and the like.

Housing 12 also a mouthpiece 40 fluidly communicating with the compartment 14 so that vaporized substance is discharged from the housing 12 via the mouthpiece 40. Mouthpiece 40 is shaped to fit into the mouth of the user, i.e., between their lips.

Generally then, the vaporizer assembly 10 may be considered to include a vaporizer 42, made up of the housing 12 and the parts thereon, and two cables 28, 36 and their optional connectors. The cables 28, 36 may be sold as a kit with the vaporizer 42, as well as separately since they would usually be commercially available cables.

Referring now to FIGS. 2-6, in one embodiment of the vaporizer 42 in accordance with the invention, the housing 12 includes a first substantially cylindrical part 44 having an upper annular edge and a second lid part 46 on which the mouthpiece 40 and an opening 48 leading to the compartment 14 are formed. The door 16 closes this opening 46. Further, the lid part 46 includes an actuator 50 that is coupled to the door 16 and movable so that it enables manually closing and opening of the door 16.

Suitable connecting mechanisms may be provided on the cylindrical part 44 and the lid part 46 to provide for a secure connection. This connecting mechanism may be a plurality of screws that pass through screw holes in an upper rim of the cylindrical part 44 into receiving apertures on a lower surface of the lid part 46.

Figure 4:
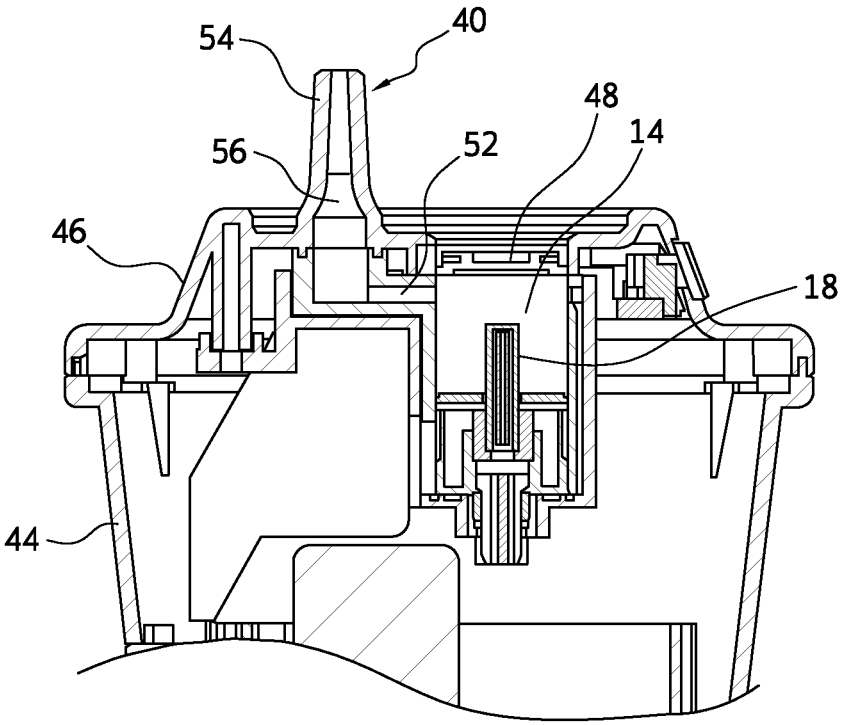
FIG. 4 is a partial cross-sectional view of the vaporizer of FIG. 2.

As shown in FIG. 4, the heating element 18 extends into the compartment 14. A passage 52 is provided between the compartment 14 and the mouthpiece 40. This passage 52 is shown leading from an upper portion of the compartment 14. However, the passage 52 may lead from a bottom of the compartment 14. Thus, the position of the inlet to the passage 52 for the compartment 14 may be optimized by those skilled in the art to maximize the inflow of vaporized substance into the passage 52 and then into the mouthpiece 40. Mouthpiece 40 has a projecting portion 54 that projects above the upper surface of the lid part 46 with an interior channel 56.

Figure 2:
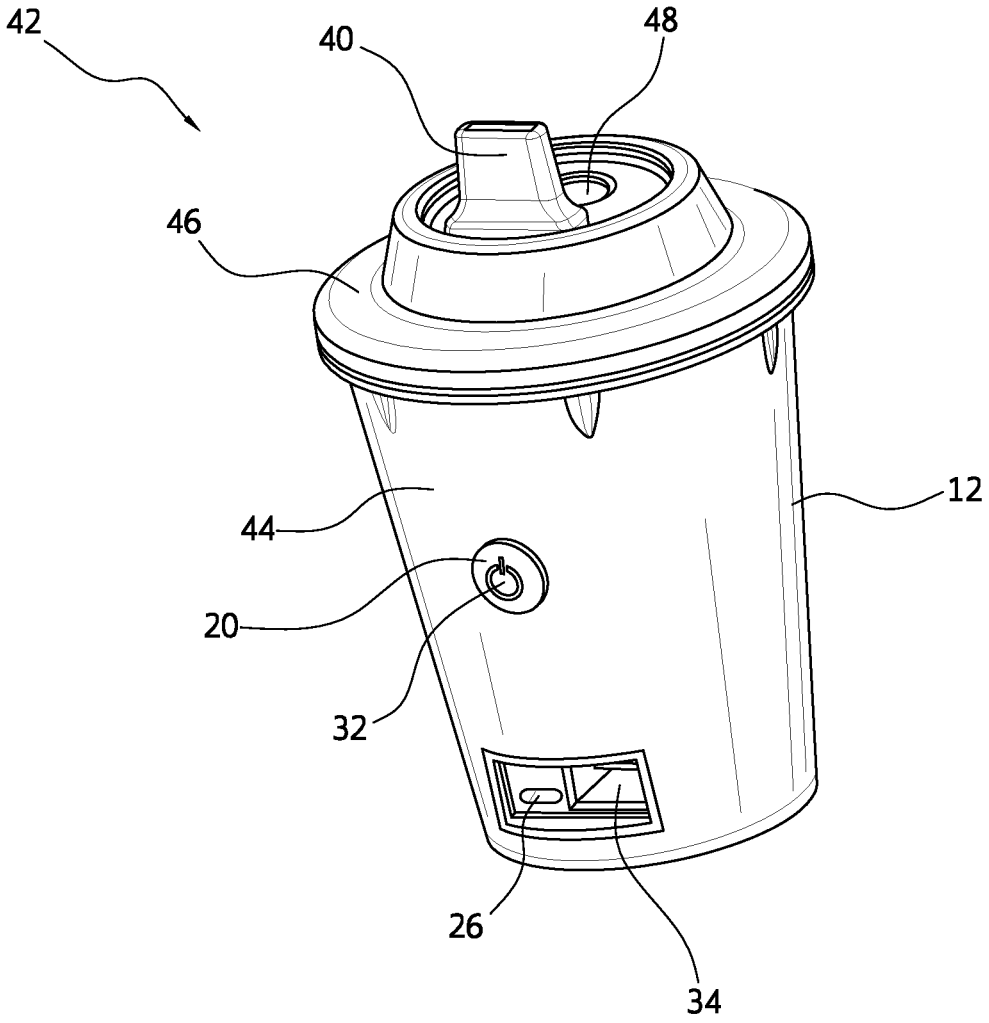
FIG. 2 is a front perspective view of the vaporizer of the vaporizer assembly of FIG. 1.
Figure 3:
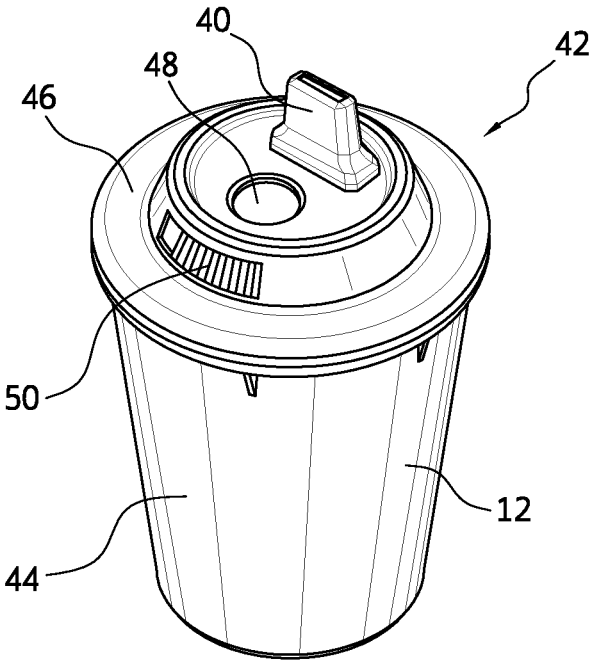
FIG. 3 is a rear perspective view of the vaporizer of FIG. 2.

As shown in FIG. 2, the first and second ports 26, 34 are adjacent one another, and the actuator 20 and indicator light 32 are arranged above the adjacent ports 26, 34 on generally the same side of the cylindrical part 42. In this embodiment, the actuator 20 for the heating element 18 is integrated with the indicator light 32. For example, the indicator light 32 is a circle on the button that constitutes the actuator 20. In this manner, the user could readily determine whether the vaporizer 42 is ready for use.

Mouthpiece 40 is also preferably closer to this same side so that the user can lift the mouthpiece 40 into their mouth while holding the cylindrical part 44 and use their thumb to selectively press the actuator 20 and control vaporization of the substance in the compartment 14.

Figure 5:
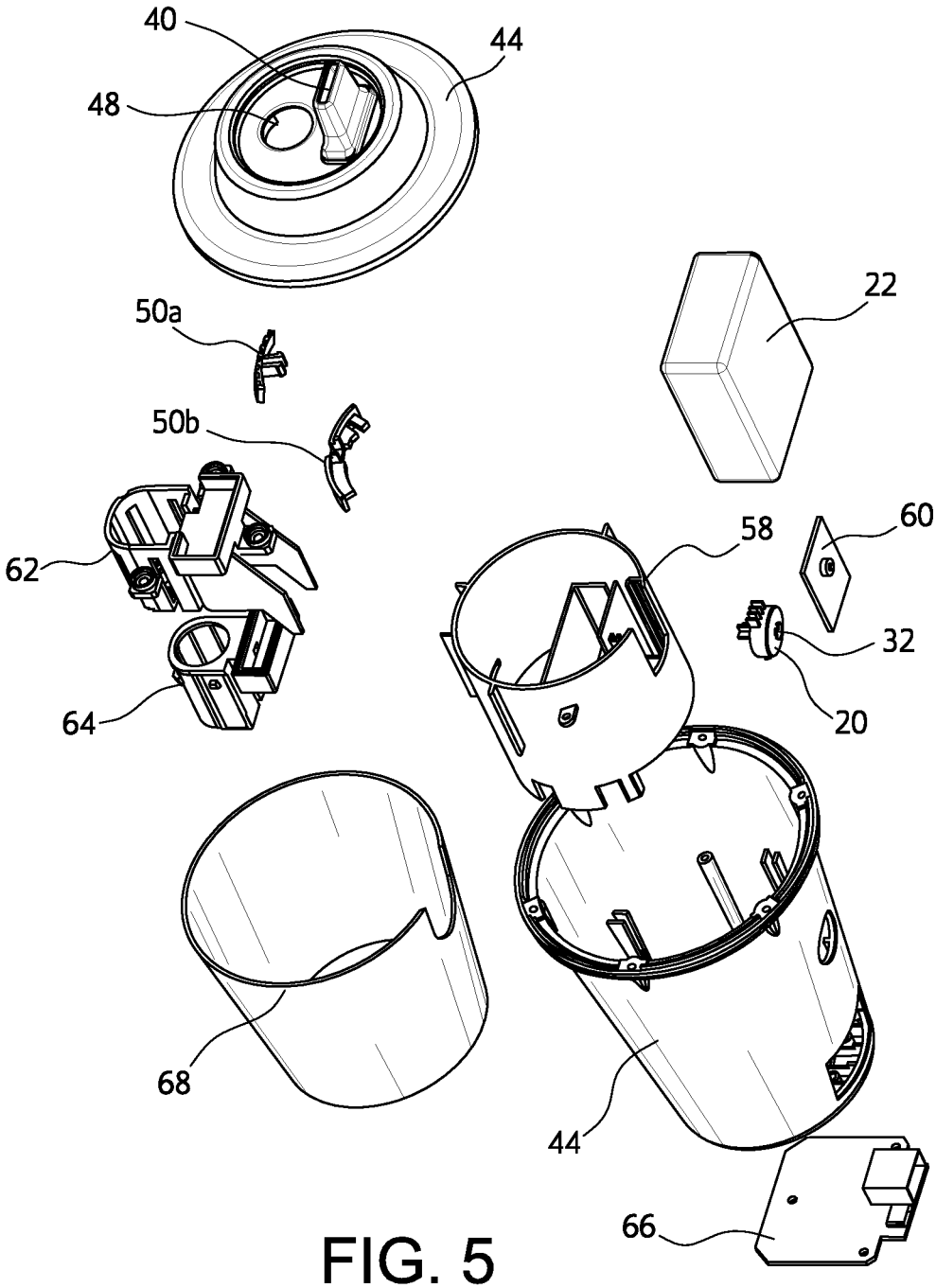
FIG. 5 is a parts diagram showing primary components of the vaporizer of FIG. 2, but not all of the components of the vaporizer of FIG. 2.

Referring now specifically to FIG. 5, additional components of the vaporizer 42 include a battery bracket 58 that holds the power storage unit (battery 8), an electronic circuit board 60 that engages with the actuator 20 and indicator light 32 and provides the electronic functions of the actuator 20 and indicator light 32, and two parts 50*a*, 50*b* of the actuator 50, two parts 62, 64 that define the passage 52 and compartment 14, a bottom plate 66 that closes the bottom of the cylindrical part 44 and an exterior support and handling member 68 with a cylindrical portion. The electronic circuit board 60 is part of or encompasses the control board 22 (see FIG. 1) that contains the hardware and embedded software to provide the functionality and operation of the components to which it is coupled, e.g., the heating element 18, actuator 20 and indicator light 32. These components do not limit the invention in any way and merely show one manner in which the vaporizer can be constructed.

Several of the components of the vaporizer assembly 10, e.g., the housing 12 and its constituent parts, may be made of plastic. Other parts are known constructions, e.g., the heating element 18, the power storage unit or battery 8, the charging unit 24, the ports 26, 34, and the cables 28, 36. Other parts, such as the actuator 20 and indicator light 32 may be made of plastic, metal or other materials, as would be readily determinable by one skilled in the art when considering the disclosure herein.

The housing 12 of the vaporizer 42 in FIG. 2 has a cup-like shape, namely, that of an inverted, truncated conical shape, which arises from the cylindrical part 44, the bottom plate 66 of FIG. 5 that closes the bottom of the cylindrical part 44, and the lid part 46 that closes an open upper end, which forms by the upper annular edge of the cylindrical part 44. FIG. 2 shows the wall of the cylindrical part 44 diverging upward to terminate at the upper annular edge. The mouthpiece 40 projects relative to a surface of the lid part 46 in a direction away from a space that is bounded by the housing 12.

There are different ways to use the vaporizer 42. One way to use the vaporizer 42 to inhale a vaporized substance is to connect the first cable 28 to the power source 30 (usually an outlet or a computer) to the first port 26 on the housing 12 to cause the power storage unit or battery 8 in the housing 12 to be charged by the charging unit 24 in the housing 12. A full charge of the power storage unit or battery 8 is recommended, although obviously a less than full charge would still enable use of the vaporizer 40. Indicator light 32 on the housing 12 will indicate when the initial charging or recharging is complete, e.g., by changing from a blinking red light to a solid green color. The corresponding status of the different lighting conditions of the indicator light 32 may be provided with instructions that accompany sale of the vaporizer assembly 10.

A substance to be vaporized, e.g., an herbal blend or tobacco, is inserted into the compartment 14 defined in the housing 12 through opening 48. This insertion may entail loosely filling the compartment 14. A packing tool 70 (see FIG. 6) may also be included the vaporizer assembly 10 and used to push the herbal blend below the door 16 and then the door 16 is manually slid closed by moving the actuator 50.

The heating element 18 in the housing 12 is then activated by pressing actuator 20 to heat the substance, e.g., for a few seconds. In one embodiment, the actuator 20 is held for at least ten seconds to enable the heating element 18 to sufficiently heat the substance in compartment 14 to cause its vaporization. This minimum time to provide for vaporization may be indicated on the instruction sheet provided in a kit with the remaining components of the vaporized assembly 10. The user places the mouthpiece 40 into their mouth. The heating element 18 is powered by the power storage unit or battery 8 causing the substance to be vaporized, and allowing for its flow through passage 52 and then inhalation by the user through the interior channel 56 of the mouthpiece 40 on the housing 12.

The user then releases pressure on the actuator 20 to stop the vaporization of the herbal blend, when desired.

Figure 6:
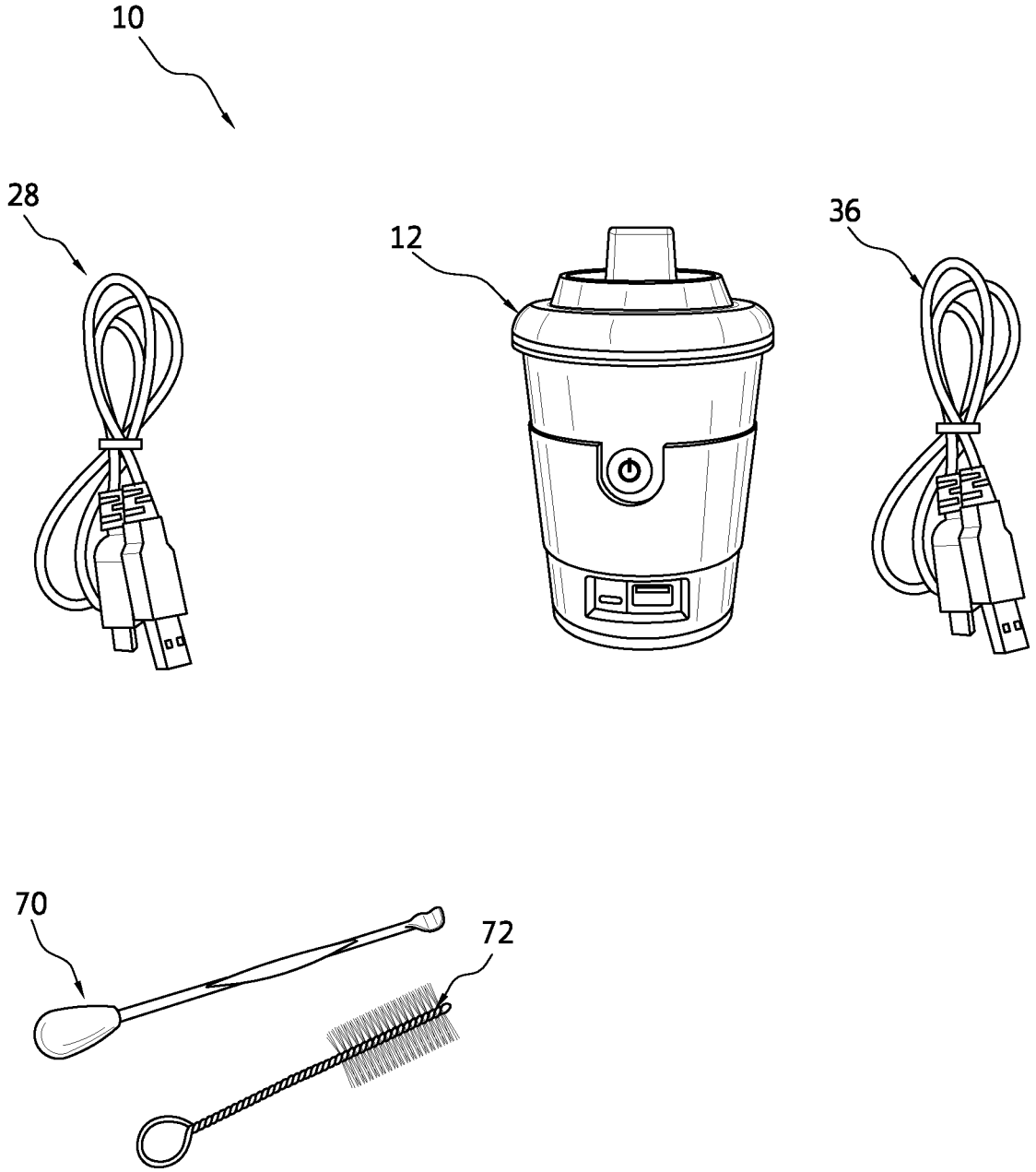
FIG. 6 shows a vaporizer assembly in accordance with the invention including optional cleaning implements.

After use, when the indicator light 32 turns a solid red color, the power storage unit or battery 8 should be recharged, The vaporizer assembly 10 may also include cleaning brush 72 for use in cleaning the compartment 14 (see FIG. 6). Periodic cleaning improves the vaporization and flow of vaporized substance and thus prolongs use of the vaporizer 42. The cleaning brush 72 is used to scrub away any residue from the compartment 14. Specifically, the door 16 is opened and the cleaning brush 72 is urged into the compartment 14. If necessary, the cleaning brush 72 may be wet with a small amount of clean water to assist in cleaning process.

The mouthpiece 40 should also be periodically cleaned. To this end, a thin pipe cleaner or tissue is obtained and a very small amount of clean water is applied. The pipe cleaner or tissue is inserted into the mouthpiece 40 to wipe away any residue from inside or around the mouthpiece 40.

A major advantage of the vaporizer 42 though is that it enables charging or use of a power using device 38 by means of the second port 34 on the housing 12 that is connectable to the second cable 36 leading to the power using device 38 and draws electricity from the power storage unit or battery 8. The vaporizer 42 can thus be used as a power storage device capable of powering, charging or recharging other electrical devices. This functionality is additional to its use as a vaporizer.

While the foregoing description and drawings represent the preferred embodiments of the present invention, it will be understood that various changes and modifications may be made without departing from the scope of the present invention.

The invention claimed is:

1. A vaporizer, comprising:

a housing defining a substance retaining compartment, said housing having a wall that terminates into an upper annular edge to define an open upper end, said wall having a shape selected from the group consisting of a cylindrical shape and an inverted, truncated conical shape indicative of a cup, said housing also including a lid that closes the open upper end, the housing having a bottom closed by a plate so that a space is bounded within confines of the housing;

a heating element that provides a sufficient amount of heat to heat said compartment when in an activated state to vaporize a substance within said compartment and that ceases to provide the heat to heat said compartment when in an inactivated state;

a mouthpiece in communication with said compartment through which the vaporized substance is discharged from said housing, said mouthpiece and an opening leading to said compartment both being formed on the lid separate from each other, said mouthpiece having a projecting portion with an interior channel that projects relative to a surface of the lid in a direction away from the space within the housing;

a power storage unit for storing electricity, said power storage unit being rechargeable and configured to provide power to said heating element to enable said heating element to heat said compartment when in the activated state;

a first port for mating with a first cable connectable to an electricity supply;

a charging unit coupled to said first port and said power storage unit for charging said power storage unit when said first port is mated with the first cable connector to the electricity supply; and a second port coupled to said power storage unit coupled to mate with a second cable connectable to a power using device such that electricity from said power storage unit powers the device via said second port and the second cable.

2. The vaporizer of claim 1, wherein said first and second ports are adjacent one another.

3. The vaporizer of claim 1, further comprising:

an actuator for controlling activation of said heating element, said actuator having a first position in which said heating element is in the activated state and a second position in which said heating element is in the unactivated state;

an indicator light; and an electronic circuit board that engages with the actuator and said indicator light and provides electronic functions of the indicator light and of the actuator.

4. The vaporizer of claim 3, wherein said actuator comprises a button exposed on said housing, whereby inward pressure on said button provides for activation of said heating element and absence of pressure on said button causes said heating element to be in the unactivated state.

5. The vaporizer of claim 1, further comprising:

a closure member for selectively closing said compartment, said closure member having a first position in which said compartment is accessible to enable placement of the substance into said compartment and a second position in which said compartment is closed.

6. The vaporizer of claim 1, further comprising:

an indicator light configured to flash during charging of said power storage unit, maintain a solid lighted condition of a first color once said power storage unit is charged, and flash when said power storage unit required recharging.

7. The vaporizer of claim 1, wherein said first port is configured with a USB connector.

8. The vaporizer of claim 1, wherein said second port is configured with a micro-USB connector.

9. A vaporizer assembly, comprising:

a housing defining a substance retaining compartment, said housing having a wall that terminates into an upper annular edge to define an open upper end, said wall having a shape selected from the group consisting of a cylindrical shape and an inverted, truncated conical shape indicative of a cup, said housing also including a lid that closes the open upper end, the housing having a bottom that is closed by a plate so that a space is bounded by confines of the housing;

a heating element that provides a sufficient amount of heat to heat said compartment when in an activated state to vaporize a substance within said compartment and that ceases to provide the heat to heat said compartment when in an inactivated state;

a mouthpiece in communication with said compartment through which the vaporized substance is discharged from said housing, said mouthpiece and an opening leading to said compartment both being formed on the lid separate from each other, said mouthpiece having a projecting portion with an interior channel that projects relative to a surface of the lid in a direction away from the space within the housing;

a power storage unit for storing electricity, said power storage unit being rechargeable and configured to provide power to said heating element to enable said heating element to heat said compartment when in the activated state;

a first port configured with a micro-USB connector;

a charging unit coupled to said first port and said power storage unit;

a second port coupled to said power storage unit coupled to mate with a second cable connectable to a power using device such that electricity from said power storage unit powers the device via said second port and the second cable; and a first USB cable having a micro-USB connector at a first end and a USB connector at a second end, said first cable being adapted to mate with a USB charger at said second end and with said first port at said first end such that when mated with the USB charger and said first port, said charging unit recharges said power storage unit, said charging unit being the USB charger.

10. The assembly of claim 9, wherein said second port is configured with a USB connector, further comprising:

a second USB cable having a micro-USB connector at a first end and a USB connector at a second end, said second cable being adapted to mate with said second port at said second end and with the power using device at said first end such that when mated with said second port and the power using device, said power storage unit provide power to the power using device.

11. The assembly of claim 9, wherein said first and second ports are adjacent one another.

12. The assembly of claim 9, further comprising:

an actuator for controlling activation of said heating element, said actuator having a first position in which said heating element is in the activated state and a second position in which said heating element is in the unactivated state;

an indicator light; and an electronic circuit board engaged with said actuator and said indicator light to provide electronic functions of the indicator light an of the actuator.

13. The assembly of claim 12, wherein said actuator comprises a button exposed on said housing, whereby inward pressure on said button provides for activation of said heating element and absence of pressure on said button causes said heating element to be in the unactivated state.

14. The assembly of claim 9, further comprising:

a closure member for selectively closing said compartment, said closure member having a first position in which said compartment is accessible to enable placement of the substance into said compartment and a second position in which said compartment is closed.

15. The assembly of claim 9, further comprising:

an indicator light configured to flash during charging of said power storage unit, maintain a solid lighted condition of a first color once said power storage unit is charged, and flash when said power storage unit required recharging.

16. A method for inhaling a vaporized substance, comprising:

closing a bottom of a housing with a plate and closing an open upper end of the housing with a lid so as to define a space within confines of the housing, the housing having a wall that terminates into an upper annular edge that defines the upper end, said wall having a shape selected from the group consisting of a cylindrical shape and an inverted, truncated conical shape indicative of a cup;

connecting a first cable leading from a power source to a first port on the housing to cause a rechargeable power storage unit in the housing to be charged by a charging unit in the housing;

providing an indicator light on the housing to indicate when recharging of the power storage unit is complete;

inserting a substance to be vaporized via an opening in the lid into a compartment defined in the housing by two parts;

activating a heating element in the housing to heat the substance by a sufficient amount to vaporize the substance that flows out of the housing through an internal channel of a projecting part of a mouthpiece in the lid, the heating element being powered by the power storage unit, whereby the heated substance is vaporized and inhalable through mouthpiece on the housing, the mouthpiece projecting relative to a surface of the lid in a direction away from the space within the housing; and enabling charging or use of a power using device by providing a second port on the housing that is connectable to a second cable leading to the power using device and draws electricity from the power storage unit.

17. The method of claim 16, further comprising:

indicating status of the recharging of the power storage unit by means of an indicator light integrated into a button that causes activation of the heating element.

18. The method of claim 16, wherein the step of inserting the substance to be vaporized into the compartment defined in the housing comprises opening a door to the compartment, then inserting the substance through the door into the compartment and then closing the door to close the compartment.

* * * * *